US005769700A

United States Patent [19]

Holden et al.

[11] Patent Number: 5,769,700

[45] Date of Patent: Jun. 23, 1998

[54] GRINDING WHEEL

[75] Inventors: Robert L. Holden, West Boylston; John P. McNamara, Clinton, both of Mass.

[73] Assignee: Norton Company, Worcester, Mass.

[21] Appl. No.: 711,636

[22] Filed: Sep. 10, 1996

[51] Int. Cl.[6] ..... B23F 21/03

[52] U.S. Cl. ..... 451/541; 451/840; 451/547; 451/527

[58] Field of Search ..... 451/541, 540, 451/547, 527, 530; 51/298, 293

[56] References Cited

U.S. PATENT DOCUMENTS

| | | | |
|---|---|---|---|
| 4,317,660 | 3/1982 | Kramis et al. | 51/295 |

FOREIGN PATENT DOCUMENTS

| | | | |
|---|---|---|---|
| 010408 | 4/1980 | European Pat. Off. | B24D 15/04 |
| 358137 | 3/1990 | European Pat. Off. | B24D 18/00 |
| 530536 | 3/1993 | European Pat. Off. | B24D 7/06 |
| 642889 | 3/1995 | European Pat. Off. | B24D 11/00 |
| 3530974 | 8/1985 | Germany | B24D 3/08 |
| 03281173 | 12/1991 | Japan | B24D 3/00 |
| 07328926 | 12/1995 | Japan | B24D 5/06 |
| 2094824 | 9/1982 | United Kingdom | B24D 11/04 |
| 2154917 | 8/1985 | United Kingdom | B24D 7/02 |
| 96/26811 | 9/1996 | WIPO | B24D 18/00 |

*Primary Examiner*—Robert A. Rose
*Assistant Examiner*—George Nguyen
*Attorney, Agent, or Firm*—Mary E. Porter

[57] ABSTRACT

A molded bonded abrasive grinding wheel adapted for relatively rough grinding operations is provided with a plurality of protuberances spaced in a predetermined pattern along the peripheral surface thereof and extending substantially orthogonally therefrom to define a textured grinding face. The protuberances are molded integrally with the grinding wheel and are formed by placing a perforated, or textured annular insert in a grinding wheel mold during molding wherein the insert is molded in-situ about the peripheral surface of the grinding wheel. The insert is removed from the peripheral surface after molding or during grinding to expose the protuberances defined by the perforations of the insert.

30 Claims, 1 Drawing Sheet

GRINDING WHEEL

BACKGROUND OF THE INVENTION

1. Field of the Invention

This invention relates to grinding wheels and more particularly, to a grinding wheel molded with a textured grinding face to facilitate use in rough grinding or conditioning operations.

2. Background Information

The grinding wheel art is highly developed and includes a wide range of wheel constructions and wheel fabrication processes adapted to optimize specific grinding operations and/or applications. One specific operation to which consideration has been given is known as conditioning. Conditioning is generally the removal of surface defects from ingots, blooms, billets and slabs of steel prior to further processing. Types of defects include cracks, folds, scale, scabs, seams, cinder patches and burned steel. Conditioning operations are generally characterized as "rough grinding" operations and utilize relatively large contact pressures between the wheel and the workpiece. Typically, grinding wheels optimized for these conditioning operations, commonly referred to as conditioning wheels, are fabricated from relatively heavy duty abrasive particulate, such as aluminum oxide, alumina zirconia, silicon carbide, or combinations thereof, of relatively large size (usually corresponding to an industry standard "grit size" of 4 through 46). Moreover, the particulate utilized for these wheels tends to be relatively hard or durable to provide resistance to the aforementioned relatively high grinding pressures. This particulate is generally maintained in a three-dimensional matrix of organic bonds, such as those provided by, for example, resinoid or phenolic resin bond material. Examples of conventional conditioning wheels are known as "BZZ Conditioning Wheels" available from Norton Company of Worcester, Mass.

As discussed hereinabove, the durability of the abrasive used in conditioning wheels serves to resist the relatively high pressures associated with the conditioning operation. The rough grinding face provided by the relatively large grit size, moreover, serves to effectively reduce the surface area of contact between the wheel and the workpiece to provide a relatively high pressure per unit area of contact therebetween. In this manner, contact pressure exerted between the exposed cutting edges of the abrasive and the workpiece is relatively high to facilitate the rough grinding or conditioning operation, while minimizing undesirable effects of excessive wheel pressure, such as uneven wheel wear or wheel breakage, as will be discussed hereinafter.

Conditioning wheels, like most other types of grinding wheels, are generally fabricated by hot or cold pressed molding operations. Disadvantageously, however, this fabrication method tends to produce wheels that emerge from the mold having substantially smooth peripheral grinding faces in which relatively few, if any, of the cutting edges of the abrasive are exposed. Thus, in the event such a smooth surface were brought into contact with a workpiece in a conditioning application, the increased contact area provided thereby would tend to reduce the contact pressure per unit area. To compensate for this condition, additional wheel pressure would generally be required to provide sufficient contact pressure between the wheel and workpiece to char or break the bonds of the grinding face and expose the cutting edges of the abrasive. Disadvantageously, however, this increased wheel pressure tends to generate non-uniform bond attrition which may lead to the wheel breaking or alternatively, becoming out of round and out of balance causing vibration during operation.

To overcome these disadvantages, most conventional conditioning wheels are subjected to an additional post-mold operation commonly referred to as "dressing." Dressing generally includes applying a sharp implement, such as crush dressing, shot facing, or conical cutter, to the smooth face of the wheel during wheel rotation to remove the outer layer of bond material therefrom. This serves to expose the relatively course texture defined by the abrasive particulate to facilitate conditioning operations. Once the abrasive particulate has been exposed, the grinding wheel will wear away during subsequent grinding operations in a conventional manner, thus continually exposing new abrasive particulate in the bond matrix.

Although this dressing operation may serve to ameliorate the problem generated by the molding process, it is not without disadvantages. In particular, this additional operation contributes disadvantageously to the manufacturing cost, as well as to the length of time or lead time required to manufacture the wheel.

Thus, a need exists for an improved grinding wheel which overcomes the disadvantages of the prior art.

SUMMARY OF THE INVENTION

According to an embodiment of this invention, a molded grinding wheel includes bonded abrasive particulate, a substantially curved peripheral surface and a plurality of surface irregularities spaced in a predetermined pattern along the substantially curved peripheral surface to define a textured grinding face.

According to a second aspect of the present invention, an insert is adapted for use in conjunction with a grinding wheel mold having a mold cavity defined by at least one curved surface. The insert includes at least one liner sized and shaped for disposition in superimposed and concentric relation with the at least one curved surface of the grinding wheel mold. The at least one liner has a plurality of discontinuities disposed therein and is adapted for being selectively molded in-situ with a grinding wheel in the grinding wheel mold, and removed from the grinding wheel, wherein the plurality of discontinuities define surface irregularities in a peripheral surface of the grinding wheel.

In a third aspect of the present invention, a method of forming a grinding wheel includes the steps of molding the grinding wheel to form a substantially curved peripheral surface and disposing a plurality of surface irregularities in a predetermined pattern along the substantially curved peripheral surface to define a textured grinding face.

In a fourth aspect of the present invention, a grinding wheel comprises a plurality of protuberances disposed on a peripheral surface thereof by providing at least one liner having a plurality of recesses disposed therein, molding the at least one liner in-situ about the peripheral surface and removing the at least one liner from the peripheral surface after molding.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
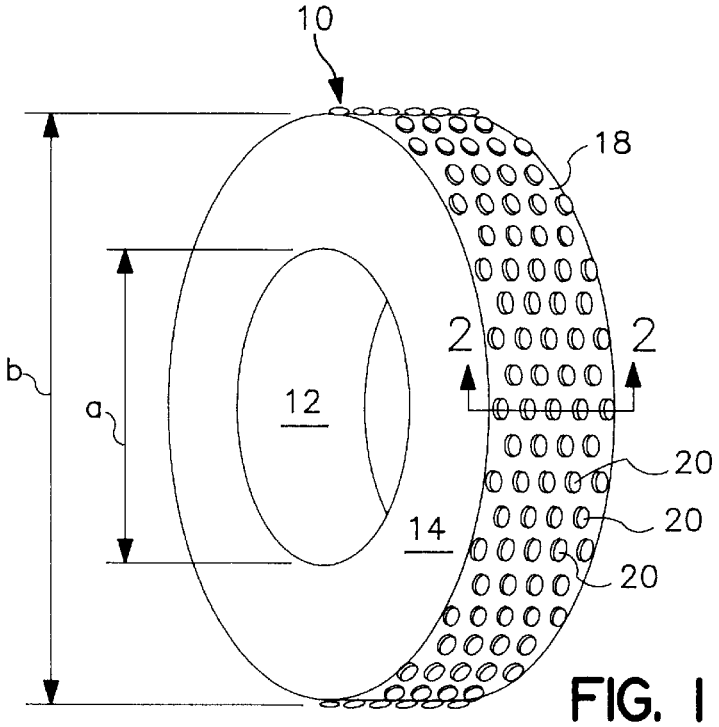
FIG. 1 is a perspective view of a grinding wheel of the subject invention.

Briefly described, as shown in FIG. 1, a molded, bonded abrasive grinding wheel 10 adapted for relatively rough grinding operations is provided with a plurality of surface irregularities, such as protuberances 20, spaced in a predetermined pattern along the peripheral surface thereof and extending substantially orthogonally or radially therefrom, to define a textured grinding face 18. Protuberances 20 are molded integrally with the grinding wheel and are formed by placing an annular insert 22 having a plurality of discontinuities, such as perforations 24, in a grinding wheel mold during molding of the wheel wherein the insert is molded in-situ about the peripheral surface of the grinding wheel. The insert is removed from the peripheral surface after molding to expose protuberances 20 defined by perforations 24.

For definitional purposes, throughout this disclosure, the term "axial" when used in connection with an element described herein, shall refer to a direction substantially parallel to the axis of a circular dimension thereof. The term "orthogonal" when used in connection with an element described herein, shall refer to a direction substantially perpendicular to a tangent of a curved surface at a point of intersection of the element with the curved surface.

Referring now to the drawings in detail, as shown in FIG. 1, grinding wheel 10 of the present invention is of conventional, generally disc-shaped construction, having a generally cylindrical inner surface or bore 12, planar side surfaces 14 and 16 (FIG. 2) and a substantially cylindrical outer surface or grinding face 18. The dimensions of the grinding wheel, including diameters of inner surface 12 and outer surface 18, as shown at a and b, respectively, as well as the thickness of the wheel as shown at t (FIG. 2), are predetermined in a conventional manner, based in part on the particular grinding application for which wheel 10 is to be employed. The grinding wheel may be fabricated from a conventional bonded abrasive material such as, for example, the type mentioned hereinabove.

In a preferred embodiment, grinding wheel 10 is a "conditioning wheel" as generally described hereinabove. Outer surface 18 has a diameter preferably within a range of from approximately 14 inches (in) to 36 in, or approximately 35 centimeters (cm) to 91 cm. Thickness t (FIG. 2) is preferably within a range of from approximately 1.5 in to 6 in, or approximately 3 cm to 15 cm. Grinding wheel 10 also preferably comprises abrasive particulate having a grit size within a range of 4 to 46, or an average diameter within a range of 0.25 in (0.65 cm) to 0.02 in (0.05 cm). The abrasive is preferably maintained within hot or cold pressed phenolic resin or resinoid bonds.

Figure 2:
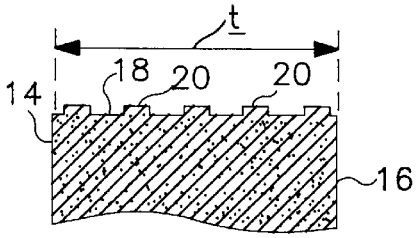
FIG. 2 is a cross-section taken along 2—2 of FIG. 1.

As shown in FIGS. 1 and 2, outer surface 18 is provided with a series of surface irregularities such as protuberances 20 which, as shown, extend orthogonally or radially outwardly therefrom. Protuberances 20 are spaced at predetermined intervals from one another about outer surface 18 and serve to provide the outer surface with a relatively rough or "knobby" texture as shown.

Figure 3:
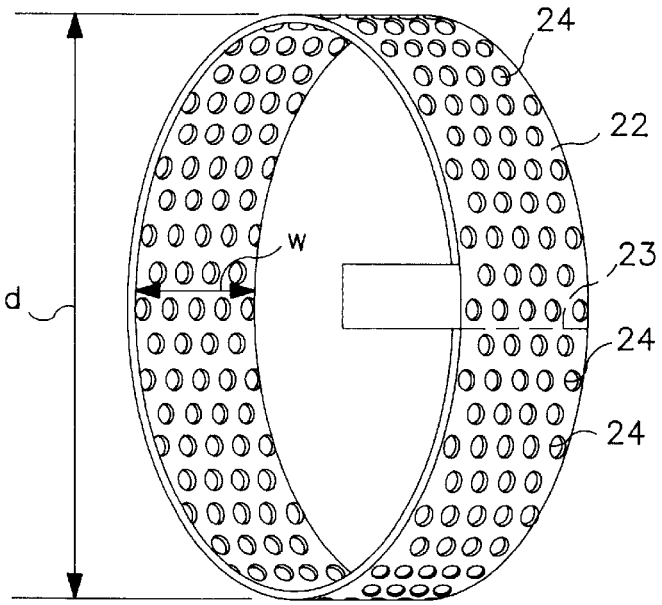
FIG. 3 is a perspective view of a component utilized to fabricate the grinding wheel of FIG. 1.

Referring now to FIG. 3, a mold liner, insert or annulus 22 is provided to facilitate molding of protuberances 20. Mold band liner 22 comprises a generally cylindrical web of predetermined diameter d and width w sized to nominally define outer surface 18 of wheel 10 as will be discussed hereinafter. The liner is preferably provided with at least one axially extending scribe or cut 23, as shown in phantom, to facilitate removal of the insert from wheel 10 as will also be discussed hereinafter. Discontinuities such as apertures or perforations 24 are spaced at predetermined intervals throughout liner 22. The perforations serve to define protuberances 20 in a manner to be discussed in greater detail hereinafter. Liner 22 is adapted to slidingly interfit in a superimposed and concentric manner with an outermost cylindrical surface of the cavity of a conventional grinding wheel mold (not shown). In this manner, liner 22 serves as a template for outer surface 18, including integral protuberances 20, of a grinding wheel 10 molded therein, as will be discussed in greater detail hereinafter with respect to the operation and fabrication of the present invention.

Liner 22 is preferably fabricated from a material capable of resisting deformation due to heat and pressure generated during hot pressed molding operations commonly employed to fabricate grinding wheels. In addition, the material is preferably relatively flexible to facilitate removal from wheel 10, as will be discussed hereinafter. In a preferred embodiment, the liner is thus fabricated from a relatively light gauge steel or aluminum, or from a paper product such as cardboard or chipboard.

In an alternate embodiment (not shown), the liner may comprise an inflatable bladder fabricated from a suitable material such as a heat resistant polymer. Such a bladder may include a plurality of discrete inflatable portions disposed on the generally cylindrical surface of the mold cavity as discussed hereinabove. It may thus be inflated during molding to define the textured grinding face 18 of the wheel and subsequently deflated to facilitate removal of the wheel from the mold in the manner to be discussed hereinafter.

A preferred embodiment of the invention having been fully described, the following is a description of the fabrication and operation thereof.

As discussed hereinabove, liner 22 is placed in concentric and superimposed orientation with the outermost cylindrical surface of the cavity of a conventional grinding wheel mold (not shown). A grinding wheel 10 is then molded in a generally conventional manner. Briefly described, a grinding wheel mixture, such as the above-described abrasive particulate and phenolic resin mixture, is deposited into the mold and subsequently either hot or cold pressed. A post bake operation may be provided, in which the wheel is maintained for a predetermined period at typical elevated cure temperatures. During these molding operations, the grinding wheel mixture will enter and fill apertures 24 of liner 22, to effectively form a grinding wheel 10 having liner 22 molded in-situ with the peripheral surface thereof.

Figure 4:
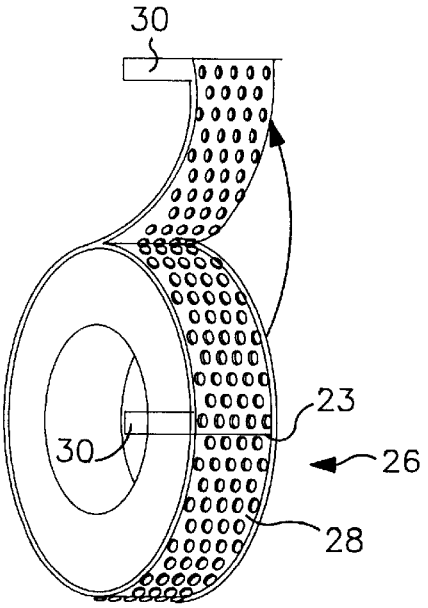
FIG. 4 is a perspective view, with portions in phantom, of the grinding wheel of FIG. 1, during a step in the fabrication thereof.

Once the molding process is complete, grinding wheel 10 and liner 22 are preferably removed from the mold as a single unitary wheel/liner assembly 26, in which liner 22 is disposed in concentric, superimposed relation with the wheel, as shown partially in phantom, in FIG. 4. As also shown, when so disposed, wheel 10 and liner 22 cooperate to provide assembly 26 with a substantially smooth, cylindrical outer surface 28 which serves to facilitate removal of wheel/liner assembly 26 from the mold without disadvantageously damaging either the wheel or the mold. In this regard, cylindrical outer surface 28 enables removal of wheel/liner assembly 26 simply by sliding the wheel/liner assembly in an axial direction out of the mold.

One skilled in the art will recognize that a molded wheel having an irregular or textured circumferential grinding face wholly defined by a wall of the mold cavity generally would not be removable from the mold simply by axial movement. Rather, irregularities in the grinding face, such as protuberances of the type described hereinabove, would tend to engage the corresponding recesses within the mold cavity and thus prevent such axial movement relative to the mold. Such a wheel would not be removable from the mold without damaging the mold and/or wheel. To avoid this problem, a segmented mold with multiple discrete sections may be used to mold wheels of the invention without using a perforated liner. Other mold types may be used. Such molds must be adapted to allow removal of the textured side walls of the mold without disturbing the grinding face of the wheel.

Once removed from the mold, liner 22 is removed from wheel 10. This may be accomplished by suitably engaging the liner proximate scribe or cut 23, such as at a tab 30, and peeling the liner away from outer surface 18 of wheel 10 as shown in FIG. 4 and continuing until the liner is completely removed from the wheel.

Once the liner has been so removed, grinding wheel 10 may then be utilized in grinding operations without further dressing operations. Indeed, the textured grinding face defined by the surface irregularities or protuberances 20 serves to effectively lower the area of contact between the wheel and workpiece. This lower contact area serves to increase the contact pressure per unit area between the wheel and workpiece to facilitate charring or breaking the bonds of the grinding face to expose the cutting edges of the abrasive as discussed hereinabove. Once cutting edges are exposed, the grinding wheel will wear away during subsequent grinding operations in a conventional manner, thus continually exposing new abrasive particulate in the bond matrix as also discussed hereinabove.

In an alternate embodiment, the liner may be fabricated from a cardboard or chipboard material as discussed hereinabove, either with or without tab 30. This material is advantageously flexible to facilitate fabrication and insertion into the cavity of the wheel mold, while it also tends to become relatively brittle when subjected to the elevated temperatures of typical post-bake operations. Accordingly, such a liner 22 may be left in-situ, in concentric orientation about wheel 10 until the wheel is used for grinding, whereupon the grinding operation itself will tend to disintegrate the liner to remove it from wheel 10. Such a cardboard or chipboard liner may thus advantageously enable elimination of the aforementioned liner removal step to further reduce manufacturing costs of wheel 10 of the subject invention.

In a further alternative embodiment, the inflatable bladder liner discussed hereinabove may be utilized to provide the textured face. In this embodiment, the step of removing the liner from the wheel may be effected simply by deflating the bladder. Moreover, the bladder may be fastened to the mold wherein deflation may be accomplished while the wheel is disposed within the mold to facilitate removal of the wheel from the mold.

The use of liner 22 thus enables a grinding wheel to be molded with an irregular outer surface to eliminate the necessity of subsequent "dressing" operations of the type mentioned hereinabove, while enabling use of substantially conventional and relatively inexpensive molds and molding techniques. Elimination of these operations advantageously serves to reduce the manufacturing cost of grinding wheels such as "conditioning wheels." Moreover, elimination of the need for dressing serves to substantially reduce the length of time or lead time required to manufacture such grinding wheels. This reduced lead time may advantageously serve to reduce inventory costs for both the wheel manufacturer and wheel purchasers. The reduced lead time also tends to enable the wheel manufacturer to provide improved service to customers, by enabling orders such as for custom or particularly large numbers of wheels to be filled relatively quickly.

The discontinuities of insert 22 and the surface irregularities of wheel 10 have been shown and described herein as generally concave recesses 24 and generally convex protuberances 20, respectively. However, it should be recognized by those skilled in the art that the discontinuities of insert 22 may comprise generally convex protuberances of the type shown and described hereinabove with respect to wheel 10, and the surface irregularities of wheel 10 may comprise generally concave recesses of the type shown and described hereinabove with respect to insert 22, without departing from the spirit and scope of the present invention.

Moreover, those skilled in the art should recognize that the discontinuities of insert 22 may be of any configuration, such as a series of troughs, striations or other convex or concave structures sufficient to provide a grinding wheel with a substantially textured grinding face, without departing from the spirit and scope of the present invention.

Although the present invention has been described herein with respect to a grinding wheel having a substantially cylindrical grinding face, the invention may be practiced with grinding wheels having a grinding face of any other substantially curved geometry, including but not limited to substantially frusto-conical, dome shaped, bowl shaped, or other concave or convex geometries, without departing from the spirit and scope of the present invention.

Although the present invention is described herein with respect to conditioning wheels, it should be understood by one skilled in the art that any type of grinding wheel may be provided with a textured grinding face as set forth herein without departing from the spirit and scope of the present invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A molded grinding wheel comprising:

bonded abrasive particulate;

a substantially curved peripheral surface; and a plurality of surface protuberances spaced in a predetermined pattern along the substantially curved peripheral surface to define a textured grinding face, wherein the plurality of surface protuberances are formed by selectively molding at least one insert in-situ about the substantially curved peripheral surface and removing the insert from the substantially curved peripheral surface after molding.

2. The molded grinding wheel of claim 1, wherein the grinding wheel is adapted for conditioning operations.

3. The grinding wheel as set forth in claim 1, wherein said substantially curved peripheral surface is substantially cylindrical.

4. The grinding wheel as set forth in claim 1, wherein the plurality of surface protuberances extend substantially orthogonally from the substantially curved peripheral surface and the textured grinding face has a knobby texture.

5. The grinding wheel as set forth in claim 1, wherein said plurality of surface protuberances are molded integrally with the grinding wheel.

6. The grinding wheel as set forth in claim 1, wherein said grinding wheel comprises abrasive particulate dispersed in a phenolic resin bond material.

7. The grinding wheel as set forth in claim 1, wherein said at least one insert comprises an annulus having a plurality of discontinuities disposed therein.

8. The grinding wheel as set forth in claim 7, wherein the plurality of discontinuities comprise a plurality of perforations in the insert.

9. The grinding wheel as set forth in claim 1 molded in a grinding wheel mold having a cavity defined by at least one curved surface, wherein said at least one insert is disposed within the cavity during molding of said grinding wheel.

10. The grinding wheel as set forth in claim 9, wherein said at least one insert further comprises a perforated annulus disposed in concentric superimposed relation with the at least one curved surface during molding of said grinding wheel.

11. The grinding wheel as set forth in claim 10, wherein said at least one curved surface and said at least one insert are substantially cylindrical.

12. The grinding wheel as set forth in claim 10, wherein said at least one insert is removable from the grinding wheel mold integrally with said grinding wheel.

13. The grinding wheel as set forth in claim 12, wherein upon removal from the grinding wheel mold, the insert is removable from the substantially curved peripheral surface to expose the plurality of surface protuberances.

14. An insert adapted for use in conjunction with a grinding wheel mold, the grinding wheel mold having a mold cavity defined by at least one curved surface, said insert comprising:

at least one liner sized and shaped for disposition in substantially superimposed and concentric relation with the at least one curved surface;

said at least one liner having a plurality of discontinuities disposed therein;

said at least one liner adapted for being selectively molded in-situ with a grinding wheel in the grinding wheel mold and removed from the grinding wheel, wherein said plurality of discontinuities define surface irregularities in a peripheral surface of the grinding wheel.

15. The insert as set forth in claim 14, wherein said plurality of discontinuities comprise a plurality of recesses and said surface irregularities comprise protuberances.

16. The insert as set forth in claim 14, wherein said at least one liner is adapted for being removed from the mold unitarily with the grinding wheel.

17. The insert as set forth in claim 16, wherein the at least one curved surface is substantially cylindrical and said at least one liner further comprises an annulus of substantially cylindrical shape, having a plurality of perforations spaced therein to define protuberances extending substantially orthogonally outward from the peripheral surface of the grinding wheel.

18. A method of forming a grinding wheel comprising the steps of:

molding abrasive particulate dispersed in a bond material to form a substantially curved peripheral surface;

molding at least one insert in-situ about the substantially curved peripheral surface, thereby disposing a plurality of surface protuberances in a predetermined pattern along the substantially curved peripheral surface to define a textured grinding face; and removing the insert from the substantially curved peripheral surface.

19. The method as set forth in claim 18, wherein the grinding wheel is adapted for conditioning operations.

20. The method as set forth in claim 18, wherein the substantially curved peripheral surface is substantially cylindrical.

21. The method as set forth in claim 18, wherein the abrasive particulate is dispersed in a phenolic resin bond material.

22. The method as set forth in claim 18, wherein said step of disposing a plurality of surface protuberances further comprises molding the surface protuberances integrally with the grinding wheel.

23. The method as set forth in claim 22, wherein said step of disposing a plurality of surface protuberances further comprises extending the protuberances substantially orthogonally from the substantially curved peripheral surface and the textured grinding face has a knobby texture.

24. The method as set forth in claim 18, wherein said at least one insert comprises a perforated annulus.

25. The method as set forth in claim 18, wherein the step of disposing a plurality of surface protuberances further comprises the step of:

disposing the insert about an inner curved surface of a grinding wheel mold during molding of the grinding wheel.

26. The method as set forth in claim 25, wherein said at least one insert comprises a perforated annulus and said step of disposing the at least one insert about an inner curved surface of a grinding wheel mold further comprises the step of:

disposing the perforated annulus in concentric superimposed relation with the inner curved surface of the grinding wheel mold during molding of the grinding wheel.

27. The method as set forth in claim 26, wherein the step of disposing a plurality of surface protuberances further comprises the step of:

removing the insert from the grinding wheel mold integrally with the grinding wheel.

28. The method as set forth in claim 27, wherein the step of disposing a plurality of surface protuberances further comprises the step of:

removing the insert from the substantially curved peripheral surface to expose the surface protuberances upon removal of the grinding wheel from the grinding wheel mold.

29. A grinding wheel having a plurality of regularly spaced surface irregularities disposed on a peripheral surface thereof, made by a method comprising the steps.

30. The grinding wheel of claim 29, wherein the liner is removed from the mold unitarily with the grinding wheel.

* * * * *